US008840407B2

(12) United States Patent
Nose et al.

(10) Patent No.: US 8,840,407 B2
(45) Date of Patent: Sep. 23, 2014

(54) CONNECTOR

(75) Inventors: Yasuhiro Nose, Tokyo (JP); Yuichi Takenaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 319 days.

(21) Appl. No.: 13/533,220

(22) Filed: Jun. 26, 2012

(65) Prior Publication Data

US 2013/0012039 A1 Jan. 10, 2013

(30) Foreign Application Priority Data

Jul. 7, 2011 (JP) ..... 2011-150664

(51) Int. Cl.

| | |
|---|---|
| ***H01R 12/00*** | (2006.01) |
| ***H01R 12/71*** | (2011.01) |
| *H01R 12/70* | (2011.01) |

(52) U.S. Cl.

CPC ..... *H01R 12/716* (2013.01); *H01R 12/707* (2013.01)

USPC ..... 439/74; 439/607.35

(58) Field of Classification Search

USPC ..... 439/74, 607.35, 607.36

See application file for complete search history.

(56) References Cited

U.S. PATENT DOCUMENTS 7,699,619 B2 * 4/2010 Mizumura ..... 439/71

FOREIGN PATENT DOCUMENTS

| | | |
|---|---|---|
| JP | 9-237655 | 9/1997 |
| JP | 3195293 | 8/2001 |

* cited by examiner

*Primary Examiner* — Ross Gushi

(74) *Attorney, Agent, or Firm* — Collard & Roe, P.C.

(57) ABSTRACT

Provided is a connector mountable on a board. The connector comprises a plurality of contacts, a housing holding the contacts, and a monitored member attached to the housing. The monitored member comprises a marker portion and an abutment portion brought into abutment with the board when the connector is mounted on the board in a vertical direction. The abutment portion is apart from the marker portion by a predetermined distance in the vertical direction. The height of the housing is indirectly measured by investigating a position of the marker portion.

12 Claims, 9 Drawing Sheets

CONNECTOR

CROSS REFERENCE TO RELATED APPLICATIONS

Applicants claim priority under 35 U.S.C. §119 of Japanese Patent Application No. JP2011-150664 filed Jul. 7, 2011.

BACKGROUND OF THE INVENTION

This invention relates, generally, to a connector to be mounted on a board, and, more particularly, to a connector used for a board-to-board connector assembly.

A board-to-board connector assembly is typically used to couple pairs of parallel boards with each other. The board-to-board connector assembly comprises two connectors (a plug connector and a receptacle connector) which are configured to be mounted on respective opposing surfaces of the boards. Examples of such board-to-board connector assemblies are disclosed in JPA H9-237655 and JPB 3195293, each of which is incorporated herein by reference in its entirety.

With the increased miniaturization of electrical equipment, such as notebook computers, cellular phones and the like, it is desirable to have the board-to-board connector assembly that will allow a distance between the boards on the order, for example, of 2.0 mm to 3.0 mm. Accordingly, a housing of the connector in the board-to-board connector assembly is also required to have a suitable size (height) for a space between the boards. Similarly to the above board-to-board connector assembly, it is required for a board connector for a low-profile mobile electrical apparatus, such as cellular phones and the like, to comprise a housing having a suitable size (height) inside the low-profile mobile electrical apparatus. In addition, investigation of the size (heights) of the housings used in the above electrical apparatuses is becoming increasingly important.

SUMMARY OF THE INVENTION

It is an object of the present invention to provide a connector having a structure which allows a simple investigation of a height of a housing included the connector even when the connector is mounted on the board.

One aspect of the present invention provides a connector mountable on a board. The connector comprises a plurality of contacts, a housing holding the contacts, and a monitored member attached to the housing. The monitored member is a separate component from the contacts and comprises a marker portion and an abutment portion brought into abutment with the board when the connector is mounted on the board in a vertical direction. The abutment portion is apart from the marker portion by a predetermined distance in the vertical direction. The marker portion is visible when seen along a horizontal direction perpendicular to the vertical direction.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 1 shows a state where the receptacle (a connector) and a plug (a mating connector) are not yet connected with each other.

Figure 1:
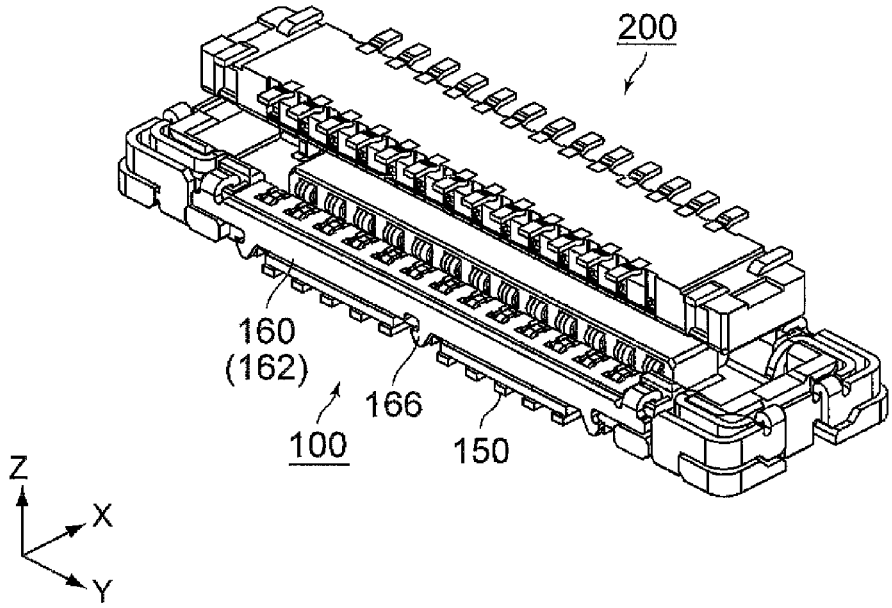
FIG. 1 is an oblique view showing a connector assembly according to the embodiment of the present invention.
Figure 2:
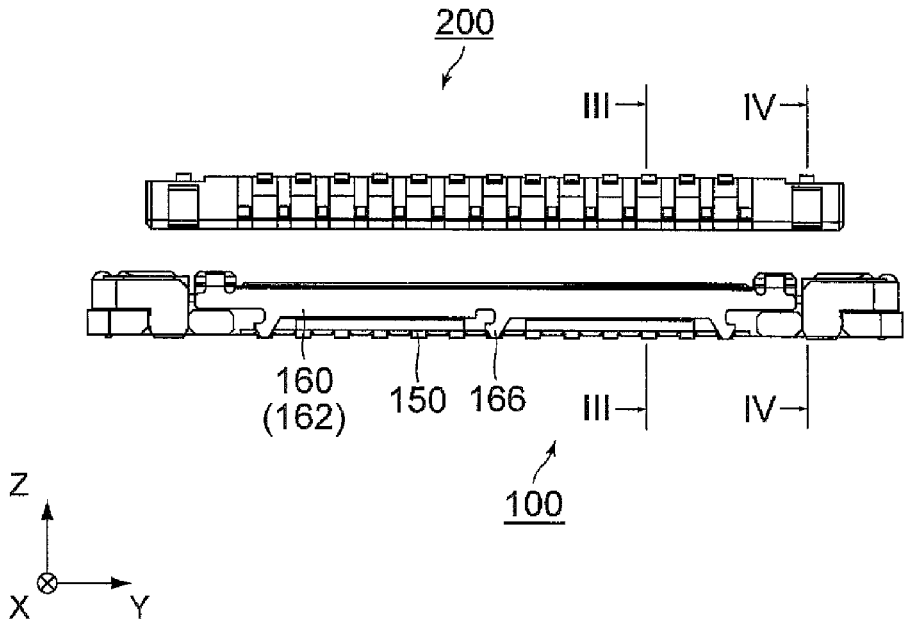
FIG. 2 is a front view showing the connector assembly of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A connector assembly of the embodiment according to the present invention is used for a board-to-board connector assembly configured to electrically connect non-illustrated boards to each other. As shown in FIG. 1 to FIG. 4, the connector assembly comprises a receptacle (a connector) 100, as one of a pair of connectors constituting the board-to-board connector assembly, and a plug (a mating connector) 200, as the other one of the pair of connectors constituting the board-to-board connector assembly. The receptacle 100 and the plug 200 are configured to be mounted on respective opposing surfaces of the non-illustrated boards. Here, the boards of the embodiment are printed circuit boards (PCBs) used, for example, in an electrical apparatus, and may be any type of board.

In addition, in the present embodiment, representations of directions such as upward, downward, forward, backward, inward, outward, and the like, used for explaining the structure and movement of each part of the receptacle 100 and the plug 200, and the like, are not absolute, but relative. These representations are appropriate when each part of the receptacle 100 and the plug 200, and the like, is in the position shown in the drawing figures. If the position of the receptacle 100 and the plug 200, and the like, changes, however, it is assumed that these representations are to be hanged according to a change in the position of the receptacle 100 and the plug 200, and the like.

Figure 5:
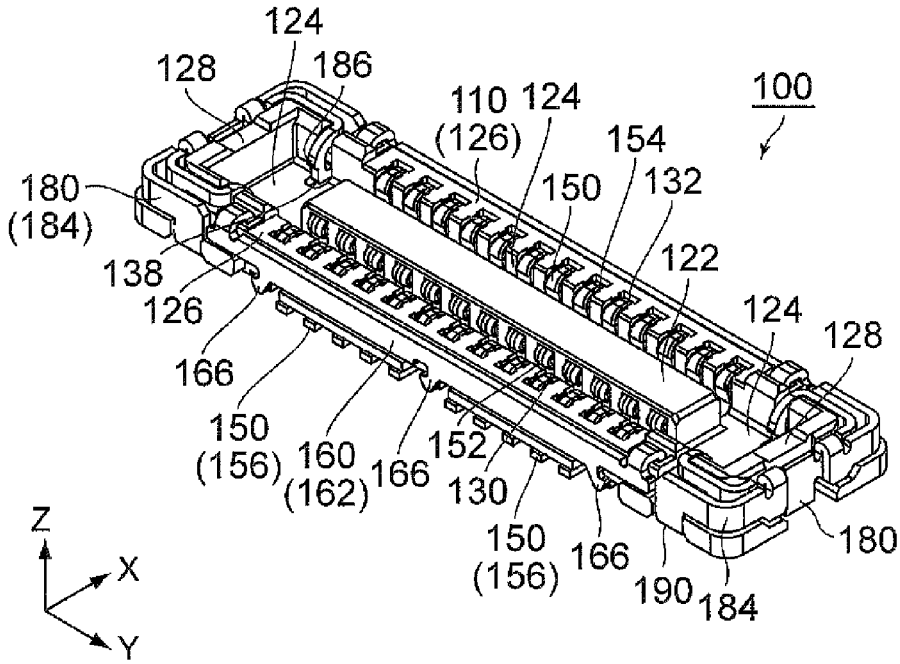
FIG. 5 is an oblique view showing the receptacle included in the connector assembly of FIG. 1.
Figure 6:
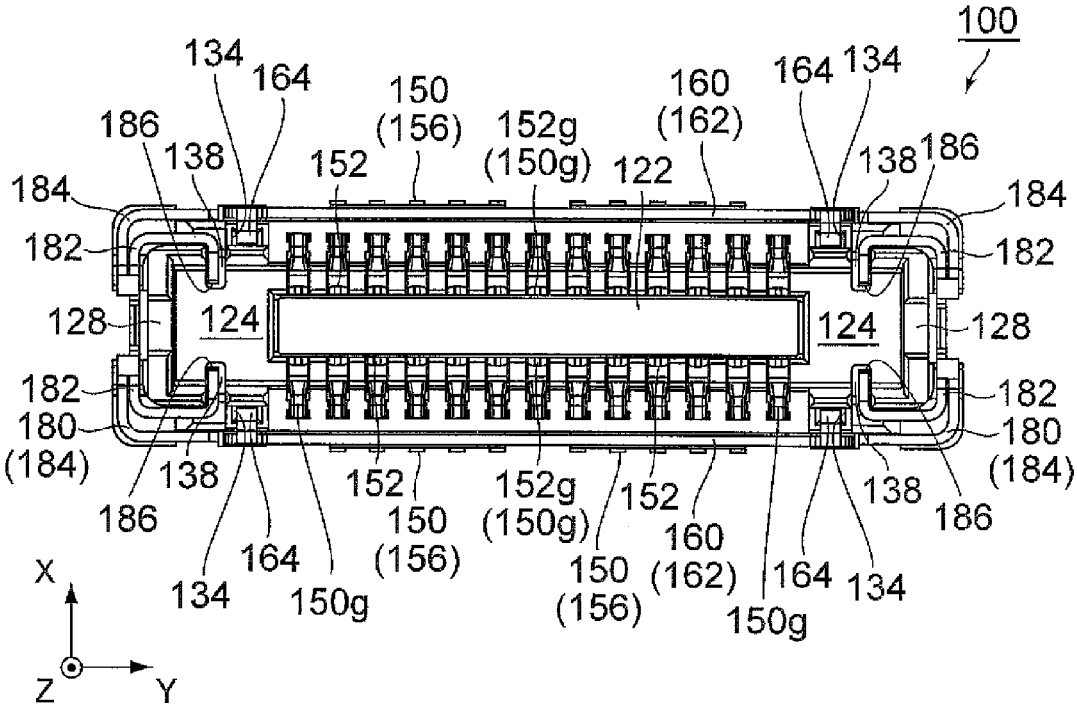
FIG. 6 is a plan view showing the receptacle of FIG. 5.
Figure 7:
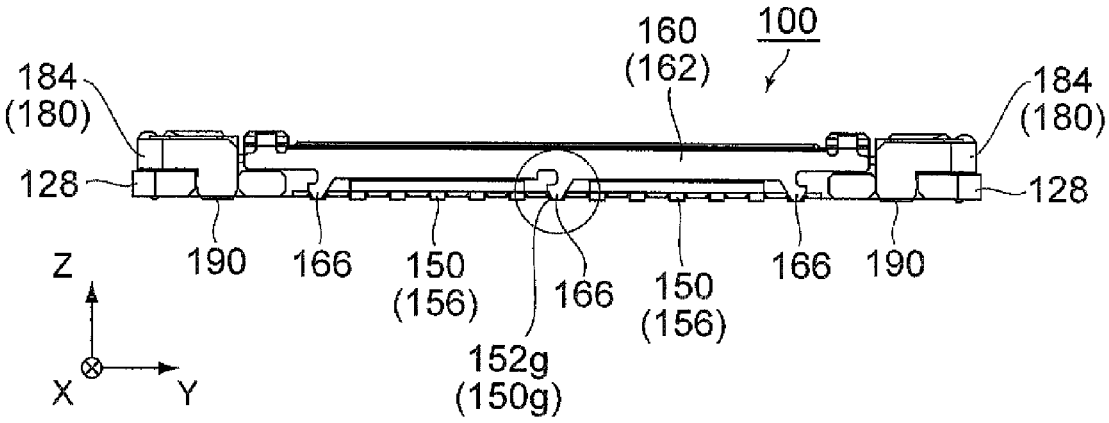
FIG. 7 is a front view showing the receptacle of FIG. 5.

With reference to FIG. 5 to FIG. 7, the receptacle 100 comprises a receptacle housing (a housing) 110 made of insulative material, a plurality of receptacle contacts (contacts) 150 made of metal, two monitored members 160 made of metal, and two lock members 180 made of metal.

Figure 10:
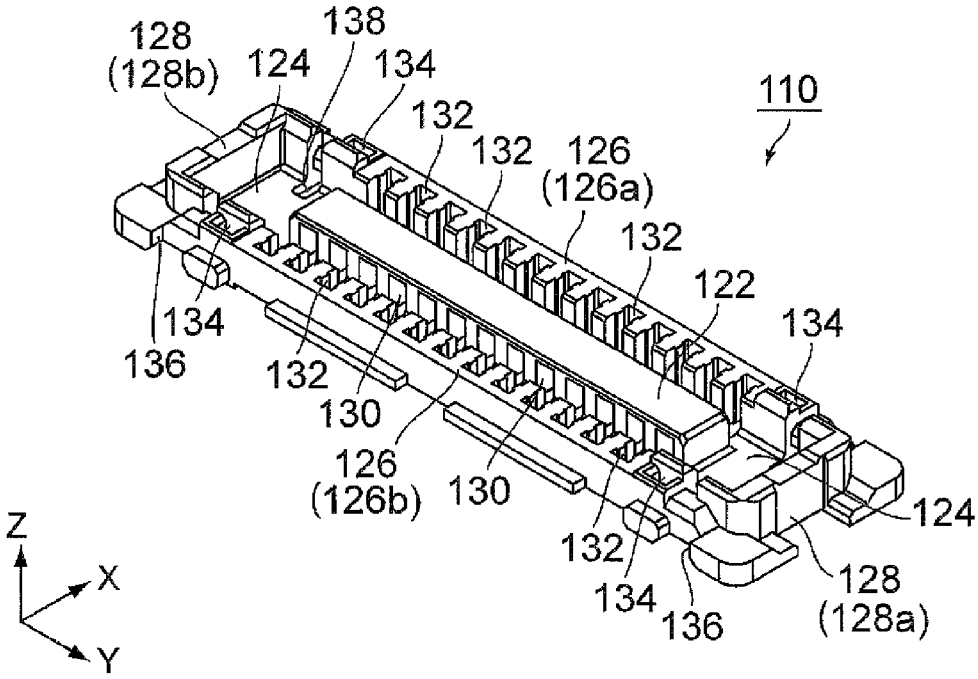
FIG. 10 is an oblique view showing a receptacle housing (housing) included in the receptacle of FIG. 5.

As shown in FIG. 10, the receptacle housing 110 is a generally parallelepiped member having a generally rectangular and has a island portion 122, a receiving portion 124, two longitudinal wall portions 126 (a +X longitudinal wall portion 126*a* and a −X longitudinal wall portion 126*b*), and two lateral wall portions 128 (a +Y lateral wall portion 128*a* and a Y lateral wall portion 128*b*). The island portion 122 has a protrusive convex shape having a rectangular parallelepiped shape extending in a Y direction and is formed integral with the receptacle housing 110. The island portion 122 is positioned at the center of the receptacle housing 110 in an X direction and the Y direction. The receiving portion 124 is provided so as to surround the island portion 122 when seen along a Z direction. The receiving portion 124 of the embodiment has a concave shape recessed downward (i.e. toward a non-illustrated board in a −Z direction) and has a rectangle frame-like shape. A bottom surface of the receiving portion 124 is lower than an upper surface of the island portion 122 in the Z direction. The longitudinal wall portions 126 protrude upward from the bottom surface of the receiving portion 124 and extend in the Y direction. The longitudinal wall portions 126 are positioned on both sides of the island portion 122 in the X direction. The lateral wall portions 128 protrude upward from the bottom surface of the receiving portion 124 and extend in the X direction. The lateral wall portions 128 are positioned on both sides of the island portion 122 in the Y direction. As shown in FIG. 10, the +Y lateral wall portion 128*a* connects one of end portions of the +X longitudinal wall portion 126*a* with one of end portions of the −X longitudinal wall portion 126*b* while the −Y lateral wall portion 128*b* connects the other one of end portions of the +X longitudinal wall portion 126*a* with the other one of end portions of the −X longitudinal wall portion 126*b*. The longitudinal wall portions 126 and the lateral wall portions 128 form a rectangle frame-like shape.

Figure 3:
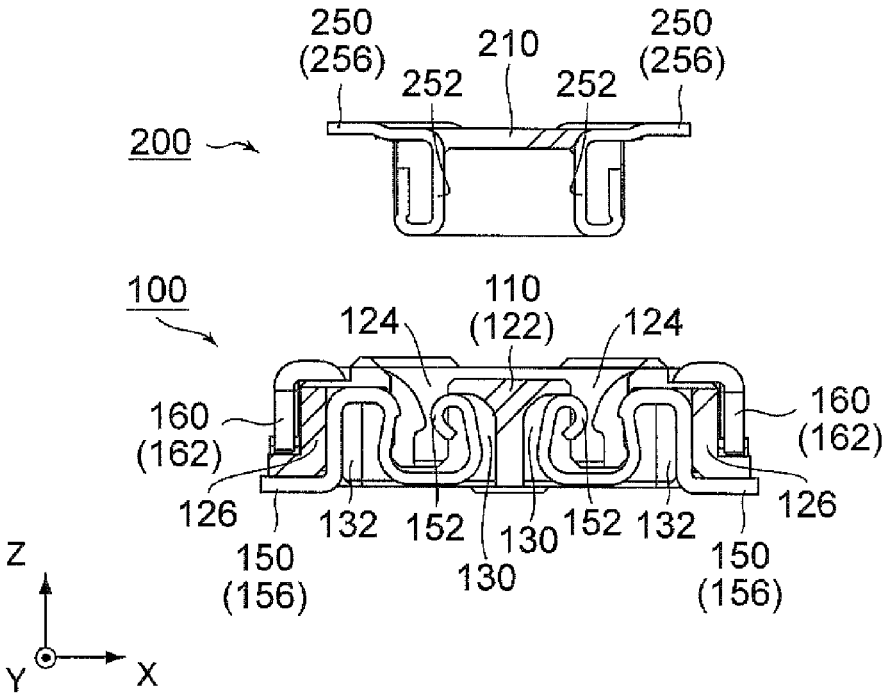
FIG. 3 is a cross-sectional view showing the connector assembly of FIG. 2, taking along line III-III.

With reference to FIG. 3 and FIG. 10, the island portion 122 is formed with a plurality of accommodation portions 130 arranged in the Y direction. In detail, the accommodation portions 130 are grouped into two groups. One of the group of the accommodation portion 130 are arranged at one of the side (in a +X direction) of the island portion 122, wherein the group referred to as "+X group". The other group of the accommodation portions 130 are arranged at the other side (in a −X direction) of the island portion 122, wherein the other group referred to as "−X group". The accommodation portions 130 of the +X group recessed inward of the island portion 122 in the −X direction while the accommodation portions 130 of the −X group recessed inward of the island portion 122 in the +X direction. As clearly seen from FIG. 3, each of the accommodation portions 130 does not penetrate the upper surface of the island portion 122. Thus, the accommodation portions 130 can not seen from above the upper surface of the island portion 122.

Figure 4:
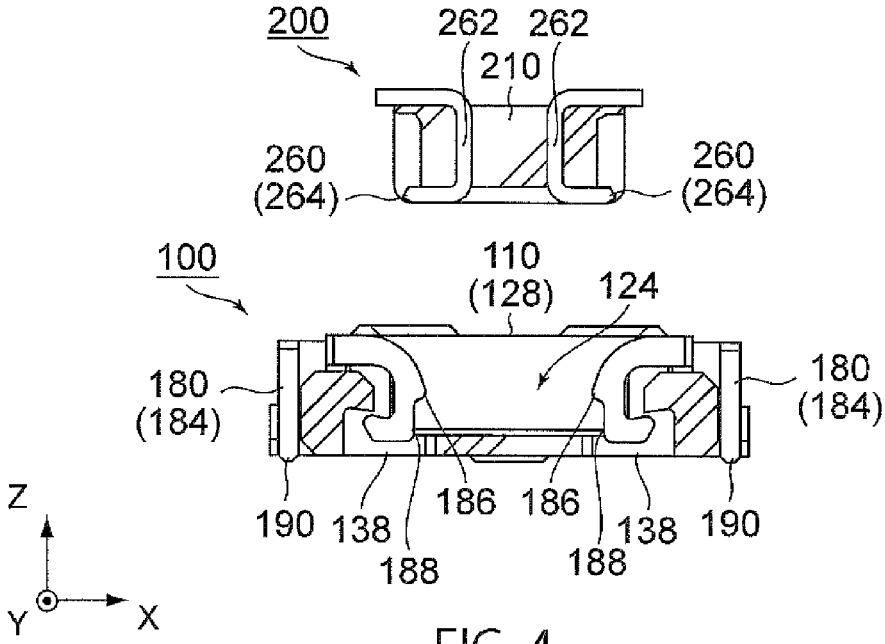
FIG. 4 is a cross-sectional view showing the connector assembly of FIG. 2, taking along line IV-IV.

With reference to FIG. 10, each of the longitudinal wall portions 126 is formed with a plurality of first holding portions 132, two second holding portions 134, and two third holding portions 136. As shown in FIG. 10, the longitudinal wall portion 126 has an inner side perpendicular to the X direction and facing the island portion 122 and an outer side opposite to the inner side in the X direction. The first holding portions 132 are formed on the inner side the longitudinal wall portion 126 and recessed toward the outer side. The first holding portions 132 of the embodiment penetrate the longitudinal wall portions 126 and the bottom of the receptacle housing 110 in the Z direction. As shown in FIG. 3, the first holding portion 132 corresponds to the accommodation portion 130 in the X direction. The second holding portions 134 are positioned on both sides of the plurality of the first holding portions 132 in the Y direction. In other words, the plurality of the first holding portions 132 formed on each of the longitudinal wall portions 126 is positioned between the second holding portions 134 in the Y direction. The third holding portions 136 are formed on the outer side of the longitudinal wall portion 126. The third holding portion 136 is positioned in the vicinity of the corner of the receptacle housing 110. In other words, the third holding portion 136 is positioned in the vicinity of boundary of the longitudinal wall portion 126 and the lateral wall portion 128. As shown in FIG. 10, the third holding portions 136 are positioned in the vicinity of the bottom of the receptacle housing 110 in the Z direction. With reference to FIG. 4 and FIG. 10, the receiving portion 124 is formed with four holes 138. The hole 138 of the embodiment penetrates the bottom surface of the receiving portion 124 (i.e. the bottom of the receptacle housing 110) and a part of the longitudinal wall portion 126.

Figure 11:
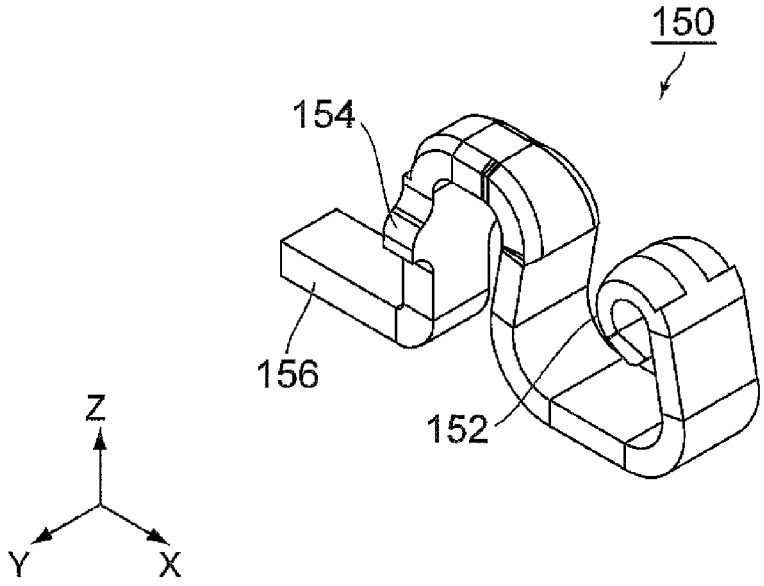
FIG. 11 is an oblique view showing a receptacle contact (contact) included in the receptacle of FIG. 5.

With reference to FIG. 11, the receptacle contact 150 has a contact portion 152, the held portion 154, and a fixed portion 156. The receptacle contact 150 and the indication of the axes illustrated in FIG. 11 correspond to the receptacle contact 150 held by the first holding portion 132 of the −X longitudinal wall portion 126*b* (see FIG. 10), wherein the receptacle contact 150 held by the −X longitudinal wall portion 126*b* is referred to as "−X receptacle contact 150" in the following explanation. However, the receptacle contact 150 held by the first holding portion 132 of the +X longitudinal wall portion 126*a* (see FIG. 10) has the structure same as the receptacle contact 150 illustrated in FIG. 11, wherein the receptacle contact 150 held by the +X longitudinal wall portion 126*a* is referred to as "+X receptacle contact 150". With reference to FIG. 3, FIG. 5 and FIG. 6, the contact portion 152 has a curved shape and configured to bend in an inverted U shape. The contact portion 152 is configured to be brought into contact with a later-described mating contact and is elastically supported so as to be displaceable in the X direction. With reference to FIG. 3 and FIG. 5 to FIG. 8, the fixed portion 156 extends outward of the receptacle housing 110 and is configured to be fixed to a surface of a non-illustrated board by means soldering or the like. With reference to FIG. 3, FIG. 5 and FIG. 6, the receptacle contact 150 is inserted from the bottom of the receptacle housing 110. In this state, the contact portion 152 is partially positioned in the accommodation portion 130 and that the held portion 154 is press-fitted into the first holding portion 132.

Figure 9:
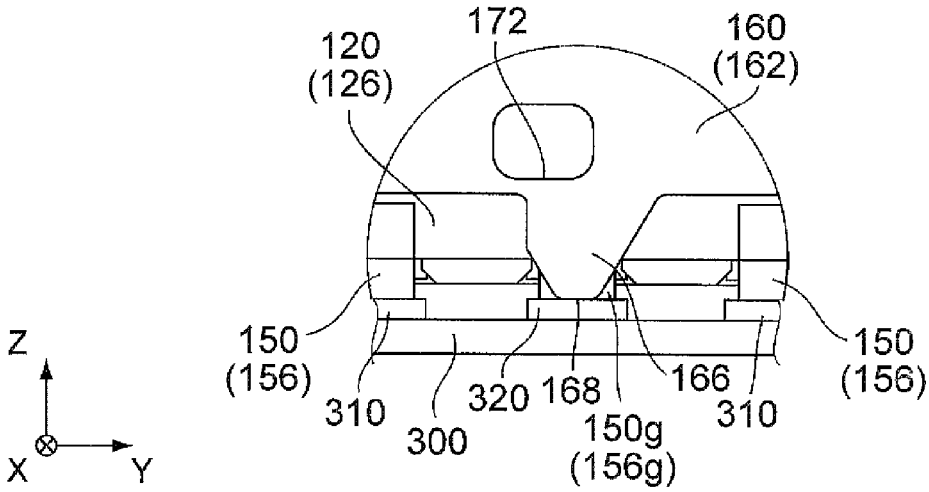
FIG. 9 is a partial enlarged view showing a variation example of the structure illustrated in FIG. 8.

As understood from FIG. 5, FIG. 6 and FIG. 9, almost all of the receptacle contacts 150 of the embodiment are connected with respective conductive patterns 310 formed on the board 300. The rest of the receptacle contacts 150 serve as ground contacts (specific contacts) 150*g* connected with ground patterns 320 formed on the board 300. Similarly to the receptacle contact 150, the ground contact 150*g* has a contact portion 152*g* and the fixed portion 156*g*. However, the length of the fixed portion 156*g* in the X direction is shorter than that of the fixed portion 156 of the receptacle contact 150. The receptacle housing 110 of the embodiment holds the six ground contacts 150*g*. In detail, three ground contacts 150 are included in each of the −X receptacle contacts 150 and the +X receptacle contacts 150.

Figure 12:
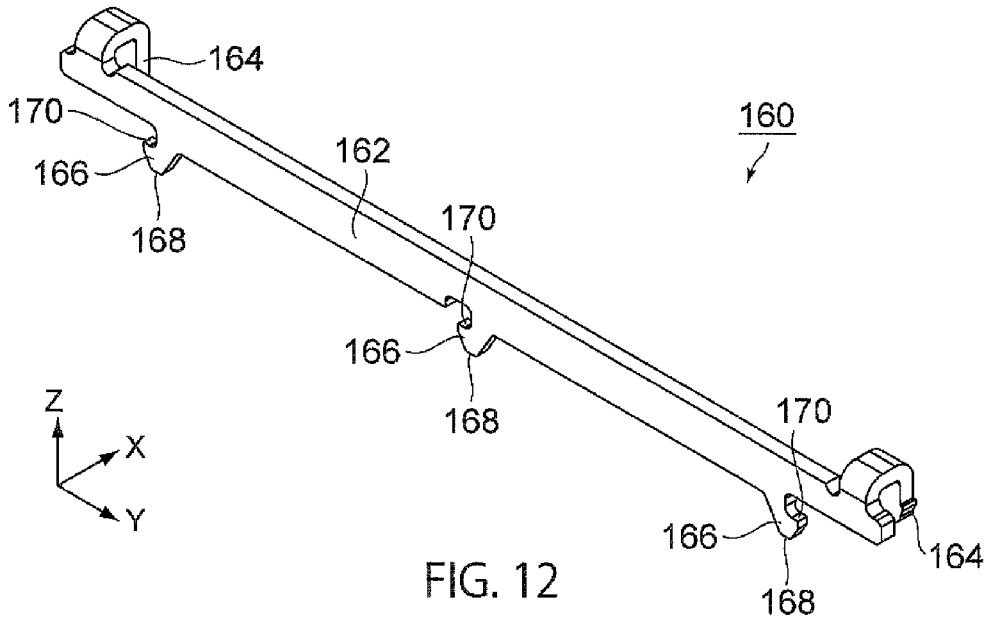
FIG. 12 is an oblique view showing a monitored member included in the receptacle in FIG. 5.
Figure 13:
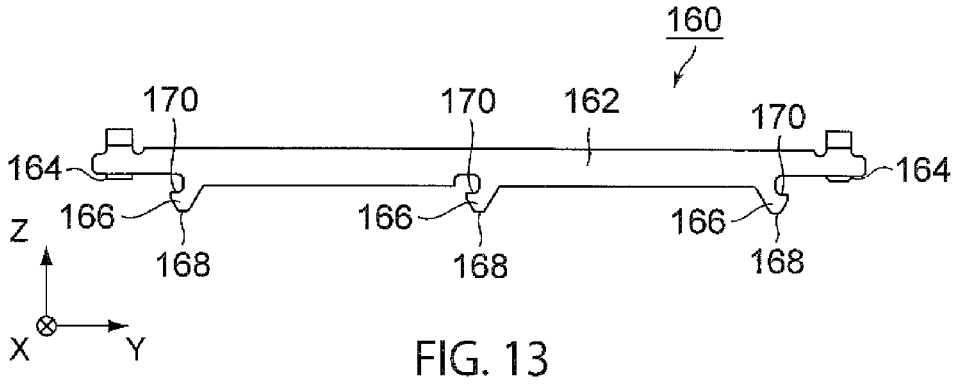
FIG. 13 is a front view showing the monitored member of FIG. 12.
Figure 14:
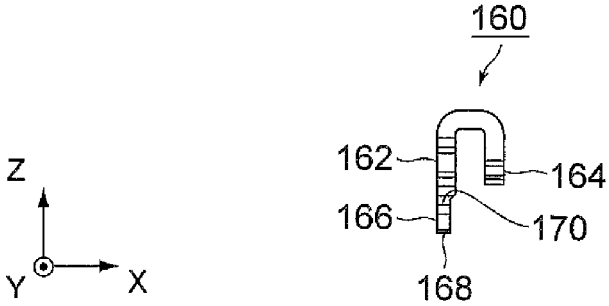
FIG. 14 is a side view showing the monitored member of FIG. 12.

With reference to FIG. 12 to FIG. 14, the monitored member 160 is formed by stamping out a blank from a base material having a sheet-like shape, followed by bending the blank. The monitored member 160 has a main portion 162, two fixed portions 164, and three protrusive portions 166. The main portion 162 has a narrow-plate like shape and extends in the Y direction. The fixed portions 164 are formed at both sides of the main portion 162 in the Y direction. The protrusive portions 166 protrude downward (in the −Z direction) from the main portion 162. The monitored member 160 and the indication of the axes illustrated in FIG. 12 correspond to the monitored member 160 positioned on the outer side of the −X longitudinal wall portion 126*b* (see FIG. 10). However, the monitored member 160 positioned on the outer side of the +X longitudinal wall portion 126*a* (see FIG. 10) has the structure same as the monitored member 160 illustrated in FIG. 11.

As shown in FIG. 6, the fixed portion 164 is press-fitted into and held by the second holding portion 134 so that, as shown in FIG. 5 and FIG. 7, the main portion 162 covers the outer sides of the longitudinal wall portion 126. The main portion 162 of the embodiment is positioned on the outer side of the longitudinal wall portion 126, and closer to the outside of the receptacle 100 than the contact portions 152 of the receptacle contacts 150. In other words, all of the contact portions 152 held in the island portion 122 are positioned between the main portions 162 in the X direction. With this structure, the main portions 162 shield the contact portions 152 against electromagnetic interference or the like. The main portion 162 of the embodiment is positioned on the vicinity of the outer side of the longitudinal wall portion 126. However, the main portion 162 may be provided at another position as long as the main portion 162 can shield the contact portions 152.

Figure 8:
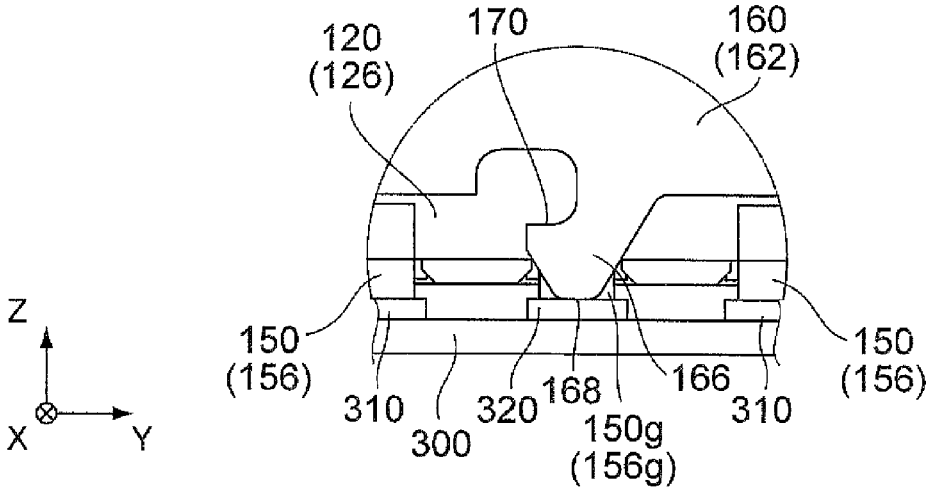
FIG. 8 is a partial enlarged view showing an area surrounded by a circle illustrated in FIG. 7. A part of the receptacle and a part of a board is illustrated.

With reference to FIG. 7, FIG. 8 and FIG. 12, the protrusive portion 166 has a hook like shape (a J-like shape) and formed with an abutment portion 168 and a marker portion 170. The abutment portion 168 is formed at a lower end of the protrusive portion 166 and is a part of a lower edge. The abutment portion 168 corresponds to a lower edge of the blank stamped out from the base material described above. The marker portion 170 is also formed as a part of the protrusive portion 166 and is apart from the abutment portion 168 by a predetermined distance in the Z direction. The abutment portion 168 of the embodiment is configured to be abutted (brought into contact with) the ground pattern 320 on the board 300. As shown in FIG. 8, the abutment portion 168 (the lower edge of the protrusive portion 166) is in parallel with the marker portion 170.

With reference to FIG. 7 and FIG. 8, the receptacle housing 110 has a predetermined height from the surface of the board 300 in the Z direction. The monitored member 160 of the embodiment is securely held by the receptacle housing 110. Thus, the height of the receptacle housing 110 is indirectly measured by investigating a distance between the surface of the board 300 and the marker portion 170 with the image recognition investigation apparatus or the like. In detail, in the case that the receptacle housing 110 is formed to have a height larger/smaller than the predetermined height, accordingly, the distance between the surface of the board 300 and the marker portion 170 is, investigated to be longer/shorter than the appropriate distance illustrated in FIG. 8. According to the embodiment, the vicinity of the surface of the board 300 (see FIG. 8) is simply magnified and investigated by the image recognition investigation so that the height of the receptacle housing 110 is measured more accurate than it is measured by directly investigating a distance between the surface of the board 300 and an upper surface of the receptacle housing 110. In order to carrying out the image recognition investigation easily, it is preferred that at least the marker portion 170 can be visible when seen along the X direction (a horizontal direction).

When an easily-deformable member is used as the monitored member 160, the distance between the surface of the board 300 and the marker portion 170 may be changed. However, in this embodiment, the protrusive portion 166 can be hardly deformed (i.e. expanded or contracted) in the Z direction so that the predetermined distance between the abutment portion 168 and the marker portion 170 is hardly changed, and, accordingly, the distance between the surface of the board 300 and the marker portion 170 is hardly changed. Therefore, the investigation used with the monitored member 160 of the embodiment is accurate. In addition, the marker portion 170 of the embodiment extends in the Y direction so that the marker portion 170 can be seen easily. As explained above, the investigation used with the monitored member 160 can achieve a high accurate measurement (scale-up observation), a prevention of changing a length of an indicator (the undeformabie-protrusive portion 166), and easy observation (the marker portion 170).

In this embodiment, the monitored member 160 made of metal has a lower thermal expansion coefficient than that of the receptacle housing 110 made of insulative resin or the like so that the investigation used with the monitored member 160 is more accurate than investigation for directly investigating the height of the receptacle housing 110. The monitored member 160 may be made of a non-metallic material as required. However, the non-metallic material is required to have a lower thermal expansion coefficient than that of the receptacle housing 110.

The shape of the marker portion 170 is not limited to the shape illustrated in FIG. 8. The marker portion 170 may have another shape as long as the distance between the marker portion 170 and the abutment portion 168 is not changed in the Z direction (in a vertical direction). For example, the monitored member 160 may be formed with a rectangular hole or a window-like portion. In this case, a bottom side of the hole can serve as the marker portion 172 as shown in FIG. 9.

As understood from FIG. 5 to FIG. 7, each of the monitored members 160 has three protrusive portions 166, and each of the longitudinal wall portions 126 holds three ground contacts 150*g*. In other words, the plug 200 has six pairs of the abutment portion 168 and the fixed portion 156*g*. As shown in FIG. 8, the pair of the abutment portion 168 and the fixed portion 156*g* is connected with one ground pattern 320. In other words, both of the fixed portion 156*g* and the abutment portion 168 are connected with one ground pattern 320. With this structure, the monitored member 160 is also electrically connected with the ground without forming a dedicated ground pattern for the monitored member 160. As explained above, the already-existing ground pattern 320 used for the ground contact 150*g* is used for the monitored member 160, i.e., one ground pattern 320 is shared between the ground contact 150*g* and the monitored member 160 (the protrusive portion 166) so that the monitored member 160 can shield the contact portions 152 without forming any additional ground pattern for the monitored member 160 nor increasing of a size of footprint (a required space on the board 300). However, the additional ground pattern for the monitored member 160 may be provided on the board 300 as required.

As shown in FIG. 8, the protrusive portion 166 is positioned outward of the ground contact 150*g* in the Z direction so as to partially overlaps the ground contact 150*g* in the X direction. In other words, as shown in FIG. 5 and FIG. 6, the fixed portion 156*g* of the ground contact 150*g* is positioned behind the protrusive portion 166. In detail, the end portion of the fixed portion 156*g* is positioned behind the abutment portion 168. With this structure, the abutment portion 168 is not brought into contact with the fixed portion 156*g*.

The fixed portion 156*g* of the receptacle contacts 150 are also observed by the image recognition investigation. When the ground pattern 320 is used by both of the fixed portion 156*g* and monitored member 160 (the protrusive portion 166), the fixed portion 156*g* is positioned behind the protrusive portion 166 so that the fixed portion 156*g* may be invisible by the image recognition investigation. In order to resolve such problem, the width of the abutment portion 168 of the embodiment in the Y direction is narrower than that of the ground contact 150*g*, in other words, the width of the ground contact 150*g* in the Y direction is formed to be wider than that of the abutment portion 168 of the protrusive portion 166. Therefore, the fixed portion 156*g* can be seen by the image recognition investigation in the X direction (see FIG. 8) even when the fixed portion 156*g* is positioned behind the abutment portion 168. However, an arrangement of the ground contact 150*g* and the protrusive portion 166 is not limited to the arrangement described above (see FIG. 8). For example, the protrusive portion 166 may be arranged between the receptacle contacts 150 or between the receptacle contact 150 and the ground contact 150*g* in the Y direction. In this case, the additional ground pattern configured to be connected with the protrusive portion 166 of the monitored member 160 may be provided.

Figure 15:
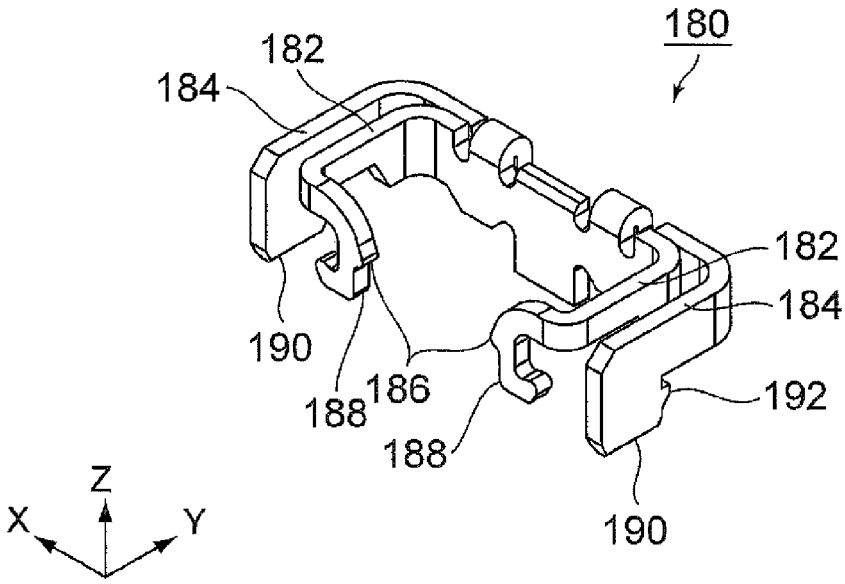
FIG. 15 is an oblique view showing a lock member included in the receptacle of FIG. 5.

With reference to FIG. 15, the lock member 180 (a supplemental member) has an inner portion 182 and an outer portion 184 which surrounds the inner portion 182. The lock member 180 of the embodiment has a rectangular C like shape when seen along the Z direction. The inner portion 182 has end portions extending downward (in the −Z direction). A lock portion 186 is formed at the vicinity of the end portion of the inner portion 182. Similarly, the outer portion 184 has end portions extending downward (in the −Z direction). Each of the end portions of the outer portion 184 is formed with an additional abutment portion 190. A held portion 192 is formed at the vicinity of the end portion of the outer portion 184 and protrudes in the Y direction. The lock member 180 and the indication of the axes illustrated in FIG. 15 correspond to the lock member 180 positioned at the +Y lateral wall portion 128*a* (see FIG. 10) in FIG. 5. However, the lock member 180 positioned at the −Y lateral wall portion 128*b* (see FIG. 10) in FIG. 5 has the same shape as the lock member 180 illustrated in FIG. 15.

As shown in FIG. 4 to FIG. 7, each of the lock members 180 is attached to the end of the receptacle housing 110 so as to cover the lateral wall portion 128 and parts of the outer sides of the longitudinal wall portions 126 (especially the end portions of the outer sides of the longitudinal wall portions 126) in an XY surface (a horizontal surface). As shown in FIG. 5, the end portion of the outer portion 184 in the Y direction is positioned close to an end portion of the main portion 162 of the monitored member 160. As clearly understood from FIG. 5 and FIG. 6, the main portion 162 and the lock member surround the contact portions 152 of the receptacle contacts 150 in the XY surface. In this embodiment, the monitored member 160 is not directly connected with the lock member 180. The additional abutment portions 190 are brought into contact with ground portion (not shown) on the board 300 so that the lock member 180 is electrically connected with the ground portion. Therefore, the monitored member 160 and the lock member 180 constitute a secure shield. The monitored member 160 may be directly connected with the lock member 180 as required. As a variation example of the secure shield, only the monitored member 160 may be constitute the secure shield when the receptacle 100 has no lock member 180.

As understood from FIG. 5, FIG. 10 and FIG. 15, the held portions 192 are inserted into the third holding portions 136 so that the lock member 180 is attached to the receptacle housing 110. As shown in FIG. 4 to FIG. 6, the end portions of the inner portion 182 are positioned in the holes 138. The lock portions 186 and the ground connect portions 188 are positioned in the receiving portion 124.

Figure 16:
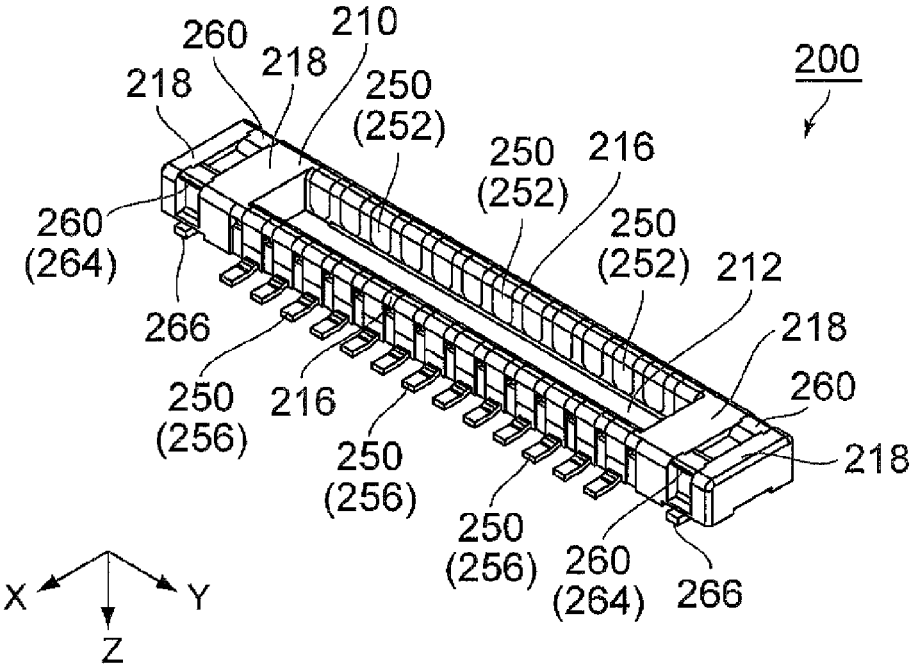
FIG. 16 is an oblique view showing the included in the connector assembly of FIG. 1.
Figure 17:
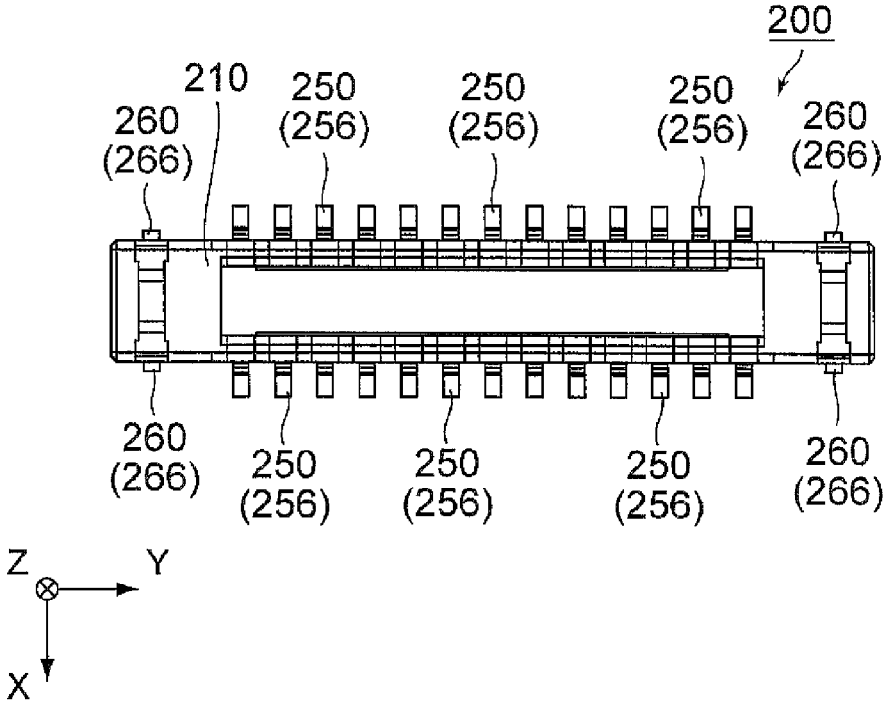
FIG. 17 is a plan view showing the plug of FIG. 16.

With reference to FIG. 16 and FIG. 17, the plug 200 comprises a plug housing (a mating housing) 210 made of insulative material, a plurality of plug contacts (mating contacts) 250 made of metal, and four hold downs 260.

Figure 18:
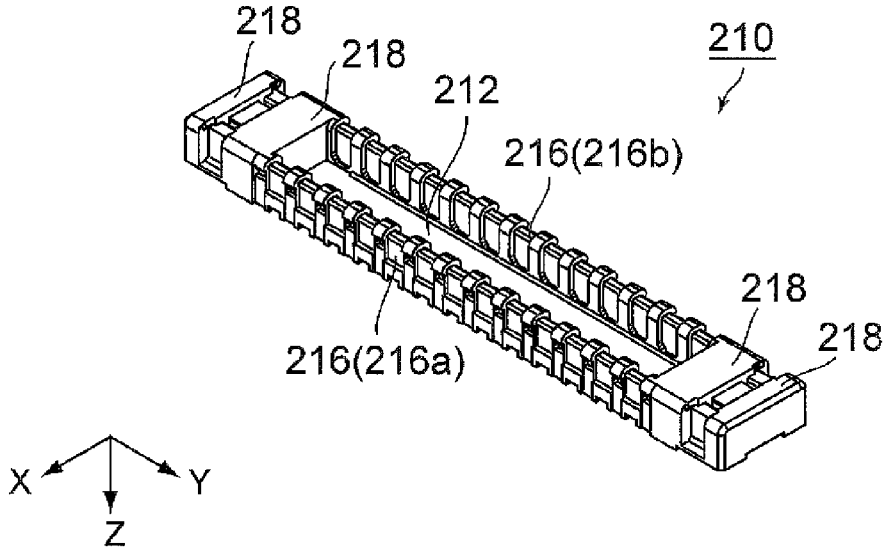
FIG. 18 is an oblique view showing a plug housing (a mating housing) included in the plug of FIG. 16.

As shown in FIG. 18, the plug housing 210 comprises a concave portion 212 recessed downward, two longitudinal wall portions 216 (a +X longitudinal wall portion 216*a* and a −X longitudinal wall portion 216*b*) and two block portions 218. The concave portion 212 positioned at the center of the plug housing 210 in the X direction and the Y direction. The longitudinal wall portion 216 has narrow-plate like shape extending in the Y direction. The longitudinal wall portions 216 are positioned at both sides of the concave portion 212 in the X direction. In other words, the concave portion 212 is formed between the longitudinal wall portions 216 in the X direction. The block portions 218 are positioned at both sides of the concave portion 212 in the Y direction. In other words, the concave portion 212 is formed between the block portions 218 in the Y direction. The block portion 218 of the embodiment connects between the end portions of the longitudinal wall portions 216 in the X direction.

Figure 19:
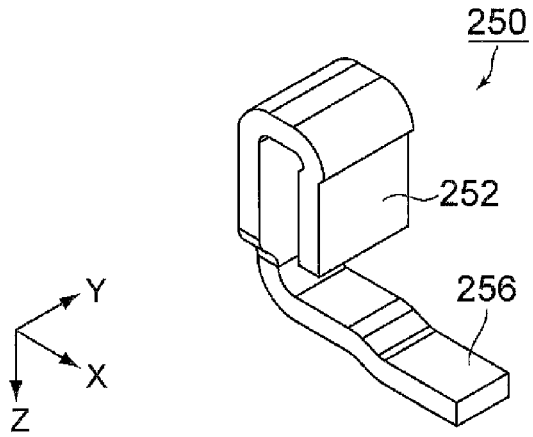
FIG. 19 is an oblique view showing a plug contact (a mating contact) included in the plug of FIG. 16.

As shown in FIG. 19, the plug contact 250 has a contact portion 252 brought into contact with the contact portion 152 of the receptacle contact 150, and a fixed portion 256 connected with or fixed to a mating board (not shown) by means of soldering or the like. The number of the plug contacts 250 is same as that of the receptacle contacts 150. As shown in FIG. 16 and FIG. 17, the fixed portion 256 is held by the longitudinal wall portion 216 so that the fixed portion 256 extends outward from the plug housing 210. The longitudinal wall portion 216 has an inner side which defines a part of the concave portion 212 and an outer side opposite to the inner side in the X direction. As shown in FIG. 16, the contact portions 252 are exposed at the inner sides of the longitudinal wall portions 216. In other words, the contact portions 252 of the inner side of the +X longitudinal wall portion 216*a* face the contact portions 252 of the inner side of the −X longitudinal wall portion 216*b* in the X direction.

Figure 20:
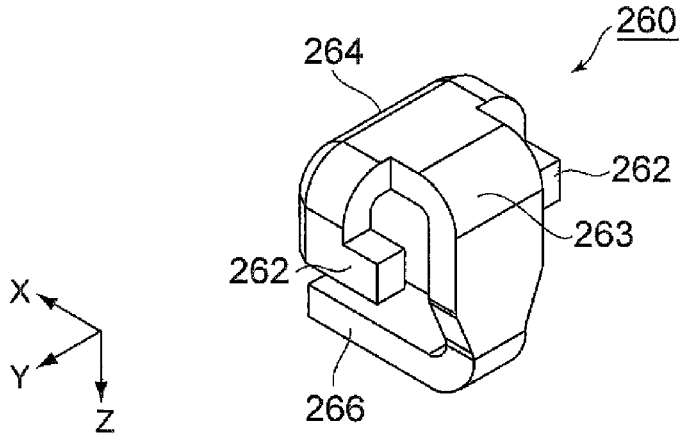
FIG. 20 is an oblique view showing a hold down included in the plug of FIG. 16.
Figure 21:
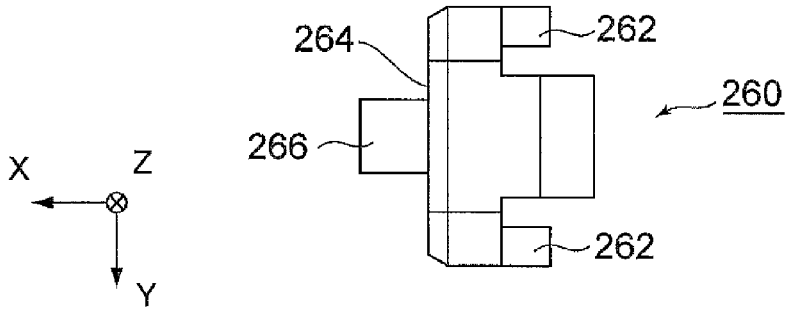
FIG. 21 is a plan view showing the hold down of FIG. 20.

As shown in FIG. 20 and FIG. 21, the hold down 260 has two buried portions 262, a main portion 263, a ground connect portion 264, and a fixed portion 266. The main portion 263 has an inverted L-like shape having an upper portion extending in the X direction and a vertical portion extending in a Z direction. Each of the buried portions 262 has an L-like shape and extends from the upper portion of the main portion 263. The upper portion is positioned between the buried portions 262 in the Y direction. The ground connect portion 264 is formed at an edge portion of the upper portion of the main portion 263 in the +X direction. The fixed portion 266 extends in the +X direction from the bottom of the side portion of the main portion 263. The hold down 260 and the indication of the axes illustrated in FIG. 20 and FIG. 21 correspond to the hold down 260 positioned at the +X longitudinal wall portion 216*a* (see FIG. 18) in FIG. 16. However, the hold down 260 positioned at the −X longitudinal wall portion 216*b* (see FIG. 18) has the same shape as the hold down 260 illustrated in FIG. 16.

As understood from FIG. 16 and FIG. 18, each of the block portions 218 holds two hold down 260. The hold down 260 and the block portion 218 are integrally formed with each other by the insert-molding process when the plug housing 210 is molded. The buried portion 262 of the embodiment is buried in the block portion 218 so that the buried portion 262 is not visible. With this structure, the hold downs 260 are securely held by and fixed to the plug housing 210. As shown in FIG. 17 and FIG. 18, the block portion 218 has two sides (an inner side serving as a boundary between the block portion 218 and the longitudinal wall portion 216, and the outer side opposite to the inner side in the Y direction). A part of the ground connect portion 264 is arranged at a corner portion including a part of the outer side of the block portion 218. The fixed portion 266 extends outward from the bottom end of the block portion 218 in the X direction.

When the receptacle 100 is connected with the plug 200, the island portion 122 of the receptacle 100 is inserted in and accommodated in the concave portion 212, and the longitudinal wall portions 216 and the block portions 218 is received by the receiving portion 124. As expected from FIG. 3, the contact portion 252 of the plug contact 250 pushes the contact portion 152 of the receptacle contact 150 in the X direction. The contact portion 252 receives reaction force from the contact portion 152 so that a secure electrical connection between the contact portion 152 and the contact portion 252 is maintained. As expected from FIG. 4, the ground connect portion 264 pushes the lock portion 186, moves downward over the lock portion 186, and are brought into contact with the ground connect portions 188. The lock portion 186 can prevent the ground contact portion 264 from moving upward so that a secure electrical connection between the ground connect portion 188 and the ground connect portion 264 is maintained.

The monitored member 160 in the above-described embodiment is provided in order to investigate the height of the receptacle 100. However, a monitored member such as the monitored member 160 may be provided on the plug 200 in order to investigate the height of the plug 200.

The present invention can apply not only the board-to-board connector but also a connector configured to be mounted on the board, especially the low-profile board connector.

The present application is based on a Japanese patent application of JP2011-150664 filed before the Japan Patent Office on Jul. 7, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a board, wherein:

the connector comprises a plurality of contacts, a housing holding the contacts, and a monitored member attached to the housing;

the monitored member is a separate component from the contacts and comprises a marker portion and an abutment portion brought into abutment with the board when the connector is mounted on the board in a vertical direction;

the monitored member is made of a predetermined material which has a lower thermal expansion coefficient than that of the housing;

the abutment portion is apart from the marker portion by a predetermined distance in the vertical direction; and the marker portion is visible when seen along a horizontal direction perpendicular to the vertical direction.

2. The connector according to claim 1, wherein the predetermined material is metal.

3. The connector according to claim 1, wherein the monitored member comprises a main portion and a protrusive portion protruding downward from the main portion in the vertical direction, the abutment portion being positioned at a lower end of the protrusive portion, the marker portion being formed as a part of the protrusive portion.

4. The connector according to claim 3, wherein the main portion of the monitored member is positioned on a side of the housing.

5. The connector according to claim 3, wherein the contacts comprise contact portions, the main portion being positioned closer to the outside of the connector than the contact portions of the contacts.

6. The connector according to claim 5, wherein the main portion or the main portion and a supplemental member surrounds the contact portions of the contacts.

7. The connector according to claim 1, wherein the monitored member comprises a main portion and a plurality of protrusive portions protruding downward from the main portion in the vertical direction, the abutment portion and the marker portion is formed at each of the protrusive portions, the abutment portion being positioned at lower end of the protrusive portion, the marker portion being formed as a part of the protrusive portion.

8. The connector according to claim 1, wherein the monitored member is formed by stamping out a blank from a base material having a sheet-like shape, followed by bending the blank, the abutment portion corresponding to an edge of the blank.

9. The connector according to claim 8, wherein the connector is configured to mate with a mating connector which mounted on a mating board.

10. A connector mountable on a board, wherein:

the connector comprises a plurality of contacts, a housing holding the contacts, and a monitored member attached to the housing;

the monitored member is a separate component from the contacts and comprises a marker portion and an abutment portion brought into abutment with the board when the connector is mounted on the board in a vertical direction;

the abutment portion is arranged so as to partially overlaps a specific one of the contacts when viewed in the horizontal direction;

the abutment portion is apart from the marker portion by a predetermined distance in the vertical direction; and the marker portion is visible when seen along a horizontal direction perpendicular to the vertical direction.

11. The connector according to claim 10, wherein, when viewed in the horizontal direction, the specific contact has a width wider than that of the abutment portion and is positioned at a back of the abutment portion.

12. The connector according to claim 10, wherein the board is formed with a ground pattern to which both of the specific contact and the abutment portion are connected.

* * * * *